US011371681B2

(12) United States Patent
Wang et al.

(10) Patent No.: US 11,371,681 B2
(45) Date of Patent: Jun. 28, 2022

(54) LUMINAIRE MOUNTING

(71) Applicant: SIGNIFY HOLDING B.V., Eindhoven (NL)

(72) Inventors: Quanguo Wang, Shanghai (CN); Yuhang Liu, Shanghai (CN); Jianzhang Song, Shanghai (CN); Feng Tian, Shanghai (CN)

(73) Assignee: Signify Holding B.V., Eindhoven (NL)

( * ) Notice: Subject to any disclaimer, the term of this patent is extended or adjusted under 35 U.S.C. 154(b) by 0 days.

(21) Appl. No.: 17/276,522

(22) PCT Filed: Sep. 13, 2019

(86) PCT No.: PCT/EP2019/074451
§ 371 (c)(1),
(2) Date: Mar. 16, 2021

(87) PCT Pub. No.: WO2020/058110
PCT Pub. Date: Mar. 26, 2020

(65) Prior Publication Data

US 2022/0034493 A1 Feb. 3, 2022

(30) Foreign Application Priority Data

Nov. 13, 2018 (EP) ..... 18205857

(51) Int. Cl.
*F21V 21/116* (2006.01)
*F21V 21/26* (2006.01)
(Continued)

(52) U.S. Cl.
CPC ..... *F21V 21/116* (2013.01); *F21S 8/085* (2013.01); *F21V 17/12* (2013.01); *F21V 21/26* (2013.01);
(Continued)

(58) Field of Classification Search
CPC ... F21S 8/08; F21S 8/085; F21S 8/086; F21V 21/116; F21V 21/26; F21V 21/30; F21W 2131/103
See application file for complete search history.

(56) References Cited

U.S. PATENT DOCUMENTS

2011/0002132 A1* 1/2011 Park ..... F21V 21/15 362/429
2012/0300481 A1* 11/2012 Kim ..... F21V 21/30 362/427
(Continued)

FOREIGN PATENT DOCUMENTS

CN 202109351 U 1/2012
CN 103629549 A 3/2014
(Continued)

OTHER PUBLICATIONS

Schefenacker, May 20, 2010, DE202010001578U1 (Year: 2010).*
(Continued)

*Primary Examiner* — Jong-Suk (James) Lee
*Assistant Examiner* — James M Endo
(74) *Attorney, Agent, or Firm* — Daniel J. Piotrowski

(57) ABSTRACT

A luminaire mounting kit including a luminaire having a mounting section with a recessed section carrying a first gear wheel portion, the recessed section being flanked by at least one protruding section carrying a second gear wheel portion and a mounting body for engaging with the mounting section, the mounting body having a protruding end portion carrying a first further gear wheel portion for engaging with the first gear wheel portion, and at least one recessed the portion flanking the end portion and carrying a second further gear wheel portion arranged to simultaneously engage with the second gear wheel portion when the first further gear wheel portion engages with the first gear wheel
(Continued)

portion. Also disclosed is a luminaire assembly and a method of mounting such a luminaire kit onto a mounting surface.

14 Claims, 8 Drawing Sheets

(51) Int. Cl.

| | |
|---|---|
| ***F21S 8/08*** | (2006.01) |
| ***F21V 17/12*** | (2006.01) |
| ***F21W 131/103*** | (2006.01) |
| ***F21V 21/30*** | (2006.01) |

(52) U.S. Cl.
CPC ..... *F21V 21/30* (2013.01); *F21W 2131/103* (2013.01)

(56) References Cited

U.S. PATENT DOCUMENTS

2013/0088861 A1* 4/2013 Wu ..... F21V 21/116 362/184
2014/0085909 A1* 3/2014 Ahn ..... F21V 29/00 362/382
2014/0105670 A1* 4/2014 Plomteux ..... F16C 11/103 403/83
2015/0354803 A1* 12/2015 Yu ..... F21V 29/83 362/19

FOREIGN PATENT DOCUMENTS

| | | | | |
|---|---|---|---|---|
| CN | 103868033 | A | 6/2014 | |
| CN | 204554540 | U | 8/2015 | |
| CN | 105135307 | A | 12/2015 | |
| CN | 103625349 | B | 7/2018 | |
| DE | 202010001578 | U1 * | 5/2010 | ..... F21V 21/116 |
| DE | 202013102664 | U1 | 7/2013 | |
| JP | 3159652 | U | 5/2010 | |
| WO | WO-2011124687 | A1 * | 10/2011 | ..... F21V 21/30 |
| WO | WO-2016172924 | A1 * | 11/2016 | ..... F21V 21/30 |

OTHER PUBLICATIONS

Cheng Shiyou, Connecting Structure for Lamp Body and Lamppost, Nov. 3, 2016, WO2016172924A1 (Year: 2016 ).*
Polenz Kai, Luminaire, in Particular for Attachment to a Pole and/or Boom, Comprising a Luminaire Head and a Luminaire Base, Oct. 13, 2011, WO2011124687A1 (Year: 2011).*

* cited by examiner

LUMINAIRE MOUNTING

CROSS-REFERENCE TO PRIOR APPLICATIONS

This application is the U.S. National Phase application under 35 U.S.C. § 371 of International Application No. PCT/EP2019/074451, filed on Sep. 13, 2019, which claims the benefit of International Application No. PCT/CN2018/10652, filed on Sep. 19, 2018 and European Patent Application No. 18205857.8, filed on Nov. 13, 2018. These applications are hereby incorporated by reference herein.

FIELD OF THE INVENTION

The present invention relates to a luminaire mounting kit comprising a luminaire having a mounting section comprising a first gear wheel portion and a mounting body for engaging with the mounting section, the mounting body comprising a first further gear wheel portion for engaging with the first gear wheel portion.

The present invention further relates to a luminaire assembly comprising such a luminaire mounting kit.

The present invention further relates to a method of mounting such a luminaire kit onto a mounting surface.

BACKGROUND OF THE INVENTION

In several lighting application domains such as road illumination, a luminaire is to be adjustably mounted to a mounting surface such that during installation the orientation of the luminaire relative to the mounting surface can be adjusted in order to direct the luminous output of the luminaire to the intended target area to be illuminated. Such installation can be cumbersome due to a combination of the weight of the luminaire and the installer having to work overhead to mount the luminaire to its target mounting surface such as a mounting post in case of street lighting for example.

In order to facilitate such installations, an interface or mounting body may be used between the luminaire and the mounting surface, which allows for the orientation of the luminaire to be adjusted. For example, in Chinese patent application CN10515307A, a rotating mechanism and a street lamp using the rotating mechanism is disclosed. The rotating mechanism comprises a frame for mounting a lamp head of a lamp pedestal, a lamp cap fixing element and a pressing plate. The lamp head base has a rotating cavity comprising an inner wall provided with a rotating shaft groove and an arc-shaped groove. The top part of the rotating cavity is provided with a fixing part having fixed regulating teeth for engaging with the pressing plate. The lamp cap fixing element comprises a lamp rod joint for connecting and fixing a lamp rod. The top of the lamp rod joint is provided with a movable adjustable gear that engages with the lamp head base, with a lamp rod joint and the pressing plate being used to fix the street lamp in its desired orientation.

A drawback of such a design is that the installation of such a lamp or luminaire is rather cumbersome, and the gear mechanism is vulnerable to stress, which can lead to premature failure of the mounting mechanism. Hence, there exists a need to provide an alternative luminaire mounting kit in which at least some of these drawbacks are addressed.

SUMMARY OF THE INVENTION

The present invention seeks to provide a luminaire mounting kit that facilitates straightforward installation of a luminaire to a mounting surface and/or is robust against stress exerted on the mounting mechanism.

The present invention further seeks to provide luminaire assembly comprising such a luminaire mounting kit.

The present invention further seeks to provide a method of mounting such a luminaire kit onto a mounting surface.

According to an aspect, there is provided a luminaire mounting kit comprising a luminaire having a mounting section comprising a recessed section carrying a first gear wheel portion, the recessed section being flanked by at least one protruding section carrying a second gear wheel portion; and a mounting body for engaging with the mounting section, the mounting body comprising a protruding end portion carrying a first further gear wheel portion for engaging with the first gear wheel portion; and at least one recessed side portion flanking said end portion and carrying a second further gear wheel portion arranged to simultaneously engage with the second gear wheel portion when the first further gear wheel portion engages with the first gear wheel portion.

The provision of a mounting mechanism in which both the luminaire and its mounting interface, i.e. the mounting body, comprise multiple gear wheels that are stepped relative to each other ensures that the stress (forces) exerted on the coupling between the luminaire and the mounting body is distributed over a greater area, such that the luminaire when mounted onto a mounting surface is more robust to component failure, thereby reducing the risk of premature failure of the mounting mechanism. At this point it is noted that in the context of the present application, a gear wheel is intended to cover an arcuate surface segment comprising a plurality of teeth or cogs for interfacing with a matching arcuate surface segment comprising a plurality of teeth or cogs. As will be understood from the foregoing, the term 'wheel portion' does not necessarily denote a closed structure, nor does it necessarily denote a structure that can rotate around an axle or the like, as will be explained in further detail below.

The wheel gear portions on each of the luminaire mounting section and the mounting body may have opposing arcuate shapes to further distribute the mounting forces between the mounting section and the mounting body when mounted onto a mounting surface. For example, the first gear wheel portion may be concavely shaped, and the first further gear wheel portion may be convexly shaped; and each second gear wheel portion may be convexly shaped, and each second further gear wheel portion may be concavely shaped.

In an embodiment, the mounting section comprises a pair of protruding sections flanking opposite sides of the recessed section and each comprising a second gear wheel portion; and the mounting body comprises a pair of the recessed side portions flanking opposite sides of the protruding end portion and each comprising a second further gear wheel portion arranged to simultaneously engage with a respective second gear wheel portion when the first further gear wheel portion engages with the first gear wheel portion. This arrangement further improves the robustness of the mounting mechanism, and facilitates the mounting of the luminaire onto a mounting surface.

The recessed side portions may extend from a main body of the mounting body, for example to allow for straightforward and cost-effective manufacture of the mounting body.

In a preferred embodiment, the luminaire mounting kit comprises at least one guide pin, wherein each protruding section comprises one of a mounting hole and a channel for receiving said at least one guide pin; and each side of the mounting body comprises another one of the mounting hole and the channel, wherein said channel allows the displacement of the mounting body relative to the mounting portion of the luminaire between a first configuration in which the first and second gear wheel portions of the mounting section are engaged with the respective first further and second further gear wheel portions of the mounting body and a second configuration in which the first and second gear wheel portions of the mounting section are disengaged from the respective first further and second further gear wheel portions of the mounting body. Hence, the at least one guide pin in combination with the channel(s) on the mounting body or luminaire mounting section allows for the mounting body to reversibly displaced from an engaged to a disengaged relationship with the luminaire mounting section, thereby facilitating easy adjustment of the orientation of the luminaire relative to its mounting surface when being mounting onto such a surface.

For example, the luminaire mounting kit may comprising a pair of said guide pins, wherein each protruding section comprises the mounting hole for receiving said one of said guide pins; and each side of the mounting body comprises the channel. The provision of a pair of such guide pins reduces the forces exerted on each of the guide pins, such that a smaller diameter pin may be used compared to embodiments in which a single guide pin extends through the mounting mechanism.

In an example embodiment, the first further and second further gear wheel portions of the mounting body and the first and second gear wheel portions of the mounting portion are dimensioned such that a fixation angle between the luminaire and the mounting body can be adjusted within a range of −20° to 20°. In the context of the present application, the term 'fixation angle' may refer to the displacement of the gear wheels of the mounting body relative to the gear wheels of the luminaire mounting section. This fixation angle therefore may define a mounting angle of the luminaire relative to a horizontal plane where the mounting body is centered on this horizontal plane.

Each second gear wheel portion may be located in between a pair of stop portions limiting a displacement range of each second further gear wheel portion relative to said second gear wheel portion. Hence, such stop portions prevent the luminaire to be installed under fixation angles outside the desired or designed range, thereby assisting the installer in correctly installing the luminaire in terms of acceptable fixation angles for the luminaire.

The luminaire mounting kit may further comprise a pair of fastening screws for fastening the mounting body to the mounting portion of the luminaire such that upon positioning of the luminaire under the desired fixation angle the fastening screws can be used to fasten the mounting body to the luminaire, thereby preventing accidental adjustment of this fixation angle. To this end, each of the side portions may delimit a slot for receiving one of said fastening screws and each of the protruding sections may comprise a threaded hole for securing one of said fastening screws.

In selected embodiments, the luminaire is a street lamp and/or the mounting body is a spigot for mounting the luminaire onto a mounting post.

According to another aspect, there is provided a luminaire assembly comprising the luminaire mounting kit of any of the herein described embodiments, such as the embodiment in which the mounting body is a spigot for mounting the luminaire onto a mounting post, and the mounting post. Such a luminaire assembly provides a robust mounting mechanism for mounting the luminaire onto the mounting post in a straightforward manner, thereby facilitating the installation of the luminaire for an installer.

According to yet another aspect, there is provided a method of mounting the luminaire mounting kit of any of the herein described embodiments onto a mounting surface, the method comprising attaching the mounting body to said mounting surface; slotting the mounting body into the mounting portion; positioning the luminaire in a desired orientation relative to the mounting body; and affixing the luminaire to the mounting body. In this manner, a luminaire can be installed onto a mounting surface such as a mounting post in a robust and straightforward manner.

Preferably, positioning the luminaire in a desired orientation relative to the mounting body comprises disengaging the first and second gear wheel portions of the mounting section from the respective first further and second further gear wheel portions of the mounting body; adjusting the orientation angle of the luminaire relative to the mounting body to obtain said desired orientation; and engaging the first and second gear wheel portions of the mounting section with the respective first further and second further gear wheel portions of the mounting body in order to facilitate the installation of the luminaire in its desired orientation.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
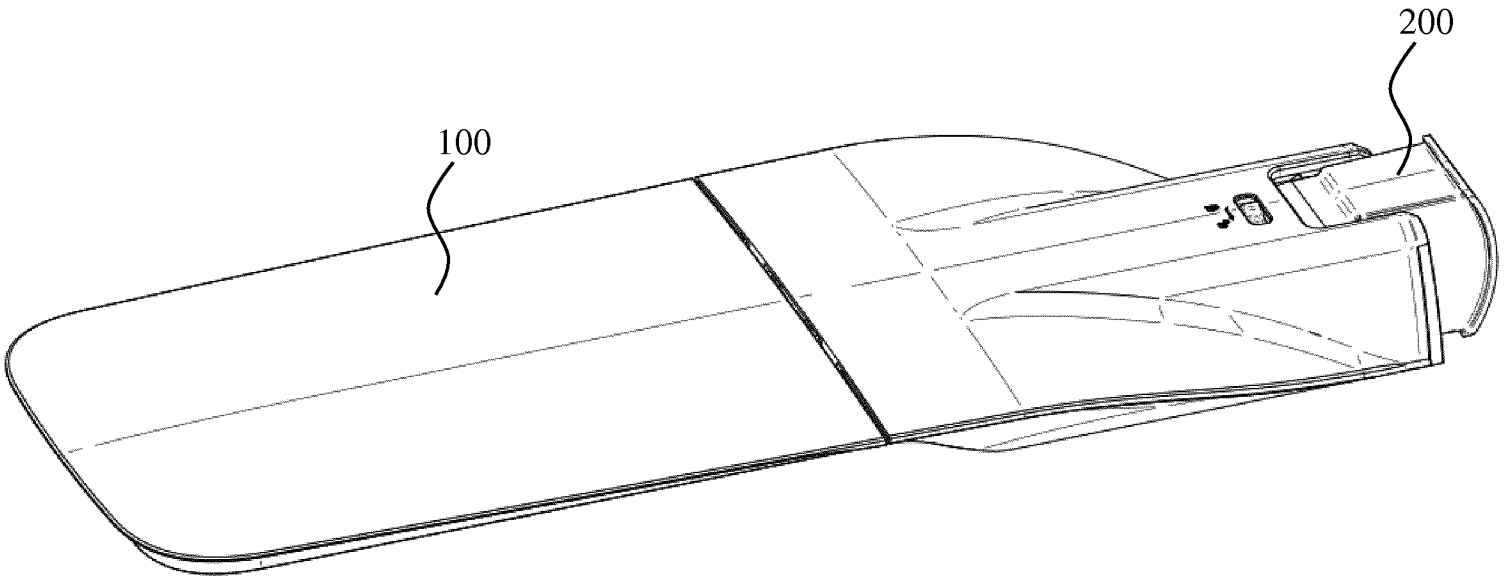
FIG. 1 schematically depicts a luminaire engaged with a mounting body according to an embodiment.

It should be understood that the Figures are merely schematic and are not drawn to scale. It should also be understood that the same reference numerals are used throughout the Figures to indicate the same or similar parts.

FIG. 1 depicts a luminaire mounting kit 10 according to an example embodiment. The luminaire mounting kit 10 comprises a luminaire 100 and a mounting body 200 for mounting the luminaire 100 onto a mounting surface. For example, the luminaire 100 may be a street lamp and the mounting body 200 may be a spigot or the like for mounting the street lamp onto a mounting post or another suitable mounting surface. The luminaire 100 may take any suitable shape and may comprise any suitable number of lighting devices. In a particular embodiment, the luminaire 100 comprises one or more solid state lighting elements such as LEDs but other suitable types of lighting devices of course may be equally contemplated.

The luminaire 100 may be mounted onto a mounting surface for the purpose of illuminating a particular area below the luminaire 100. For example, in case the luminaire 100 is a street lamp, the luminaire 100 may be installed to illuminate a particular area of a street, road, pavement, parking lot or any other type of publicly accessible open space at which a particular illumination profile across the open space is desirable. A problem that often arises in such a scenario is that there are limited locations available at which the luminaire 100 may be installed. This therefore requires that the engagement between the luminaire 100 and the mounting body 200 is adjustable such that the directional luminous output of the luminaire 100 can be directed towards the target area to be illuminated. However, the provision of an adjustable mechanism between the luminaire 100 and the mounting body 200 can compromise the structural integrity of this engagement, which can reduce the lifetime of this coupling mechanism. To this end, at least some embodiments of the present invention provide a luminaire mounting kit 10 in which a robust adjustable coupling mechanism between the luminaire 100 and mounting body 200 is provided, which allows for the relative orientation of the luminaire 100 to the mounting body 200 to be adjusted in a straightforward manner.

Figure 2:
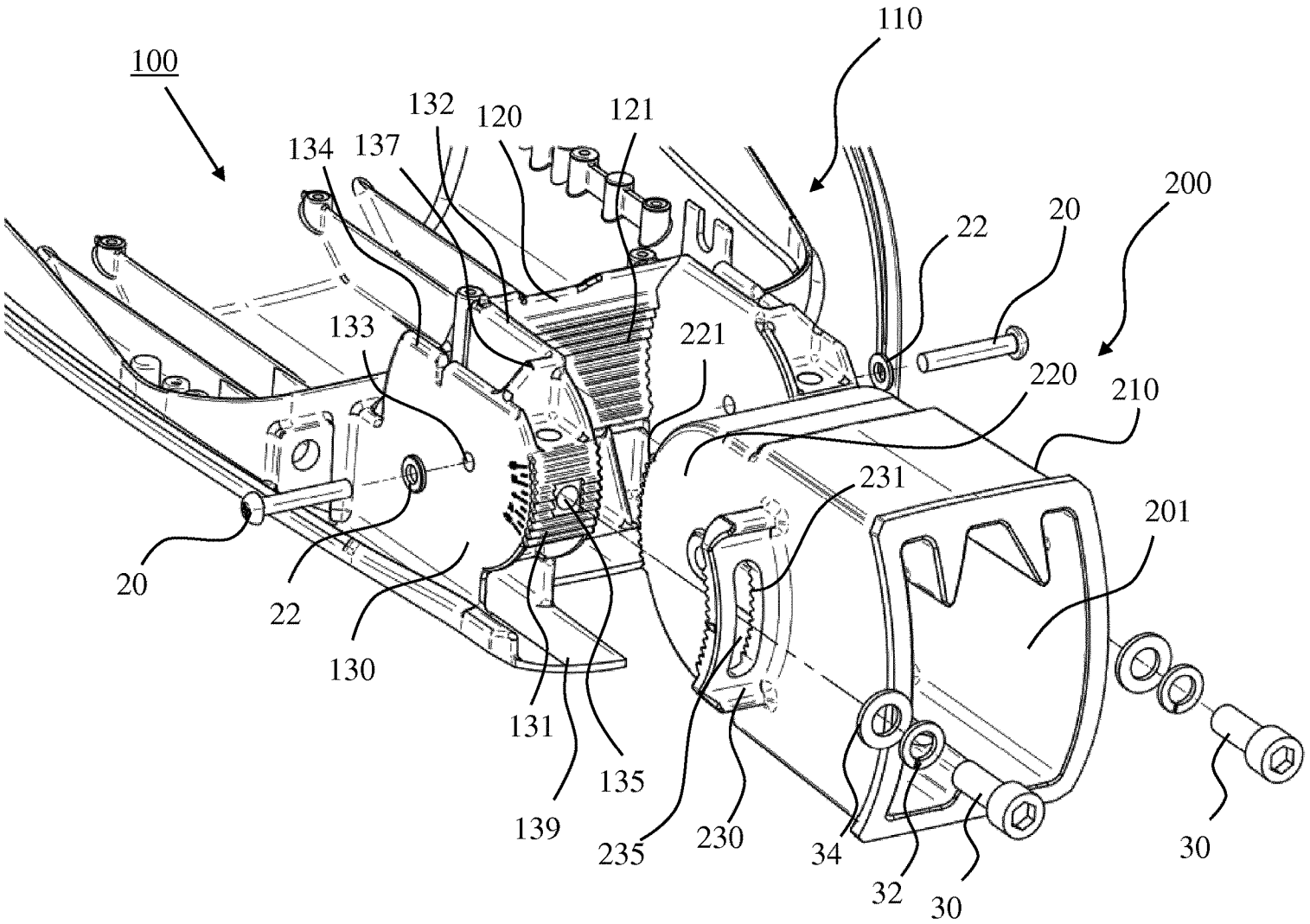
FIG. 2 schematically depicts a perspective view of a luminaire kit comprising a luminaire and a mounting body according to an embodiment.
Figure 3:
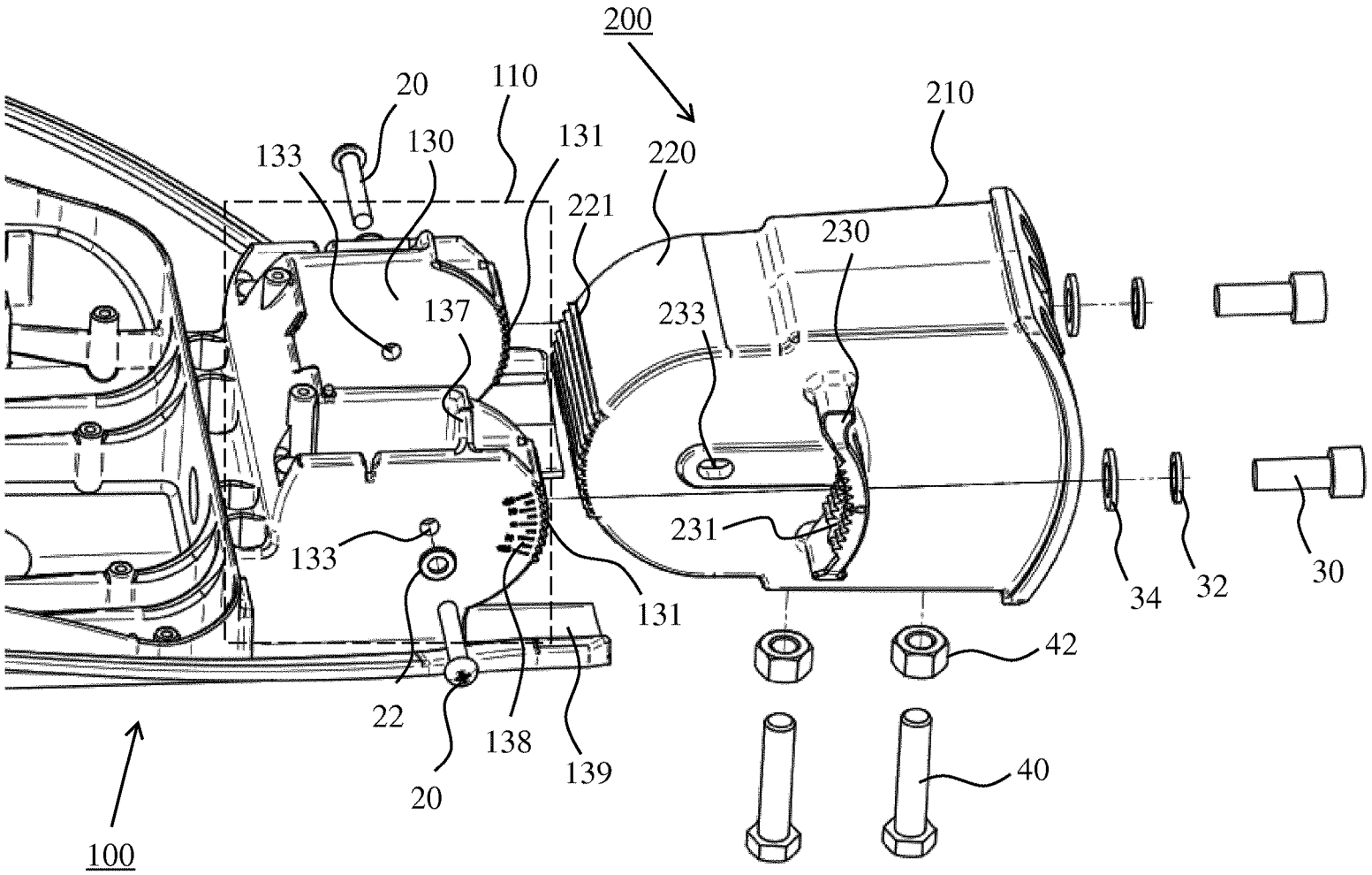
FIG. 3 schematically depicts a side view of a luminaire kit comprising a luminaire and a mounting body according to an embodiment.

FIG. 2 schematically depicts a perspective view and FIG. 3 schematically depicts a side view of such a luminaire mounting kit 10, in which part of the luminaire 100 and the mounting body 200 are visible. In particular, in accordance with embodiments of the present invention, the luminaire 100 comprises a mounting section 110, which typically is located at a terminus of the luminaire 100 to be mounted onto a mounting surface such as a mounting post for example. The mounting section 110 comprises a recessed arcuate surface section carrying a regular pattern of teeth or cogs, from here on referred to as a first gear wheel portion 121. The first gear wheel portion 121 in the recessed section of the mounting section 110 is flanked by at least one protruding section 130 including an arcuate forward facing surface section carrying another regular pattern of teeth or cogs, from here on referred to as a second gear wheel portion 131.

As will be understood from FIG. 2 in particular, the first gear wheel portion 121 and the at least one second gear wheel portion 131 are facing in the same direction, i.e. face the same virtual plane. In other words, the mounting section 110 comprises a stepped profile including the first gear wheel portion 121 on a recessed arcuate surface section and a second gear wheel portion 131 on a forward facing arcuate surface section of the at least one protruding section 130, with the recessed surface section and the protruding surface section being connected via a side surface 132 of the protruding section 130 facing the recessed surface section carrying the first gear wheel portion 121. Each protruding section 130 may further comprise a further side surface 134 opposing the side surface 132, with the forward facing arcuate surface section extending between the opposing side surfaces 132, 134. Such a stepped arrangement ensures that the stress forces between the mounting section 110 of the luminaire 100 and the mounting body 200 when the luminaire 100 has engaged with the mounting body 200 are distributed over a large area of the mounting section 110, thereby reducing the risk of component failure during such an engagement. It is noted that although in FIG. 2 and FIG. 3 the mounting section 110 is shown to comprise a pair of protruding sections 130 flanking opposing sides of the recessed surface section carrying the first gear wheel portion 121, this is by way of non-limiting example only as it is for instance equally feasible to omit one of the two protruding sections 130 without departing from the teachings of the present invention.

Figure 4:
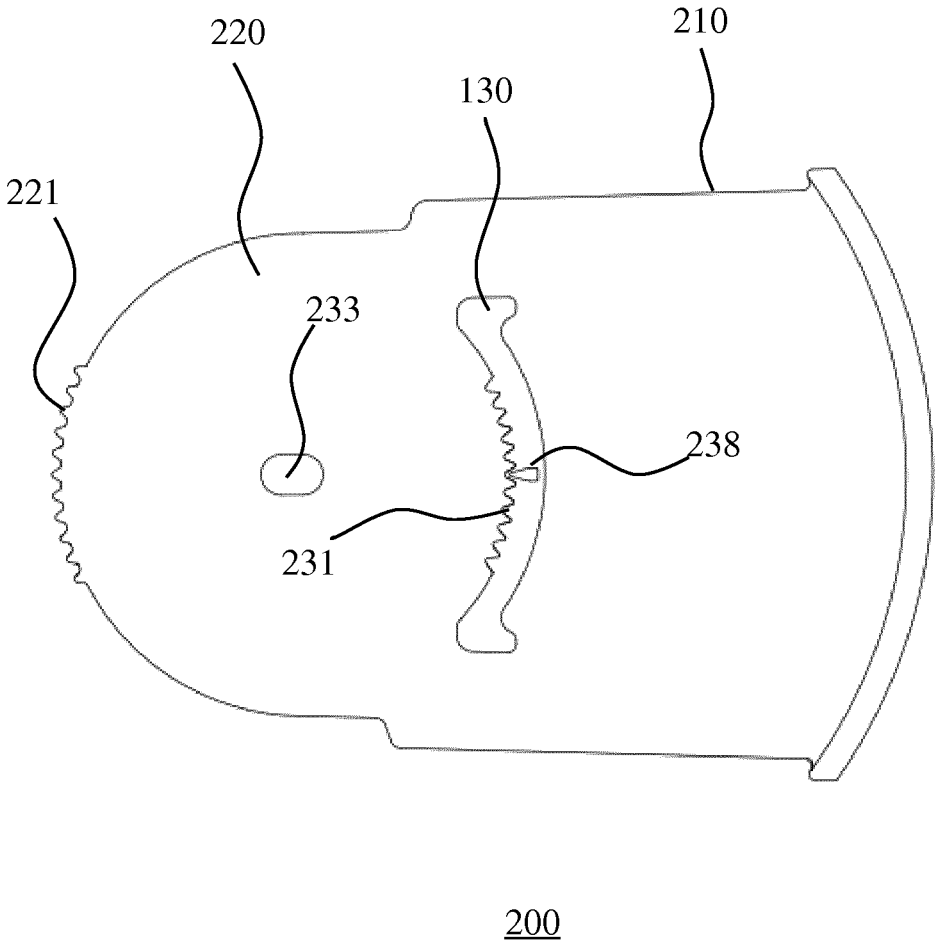
FIG. 4 schematically depicts a side view of a mounting body of a luminaire kit according to an embodiment.

In order to be able to engage with the mounting section 110, the mounting body 200 comprises a reciprocal stepped arrangement. More specifically, the mounting body 200 comprises a main body 210 having a protruding end portion 220 having an arcuate surface portion carrying a first further gear wheel 221 for engaging with the first gear wheel 121 and at least one recessed arcuate side portion 230 flanking the end portion 220. A detailed side view of the mounting body 200 is schematically depicted in FIG. 4. Each recessed side portion 230 carries a second further gear wheel portion 231 arranged to simultaneously engage with the second gear wheel portion 131 when the first further gear wheel portion 221 engages with the first gear wheel portion 121, i.e. during engagement of the mounting body 200 with the mounting section 110 of the luminaire 100, all respective gear wheel portions are simultaneously engaged with each other to redistribute the stress forces on the coupling between the luminaire 100 and mounting body 200 as previously explained.

In a particular embodiment, the one or more recessed arcuate side portions 230 extend from the main body 210, e.g. are attached thereto in any suitable manner, although it should be understood that this is by way of non-limiting example only as it is of course equally feasible for the one or more recessed arcuate side portions 230 to form an integral part of the main body 210, in which case the main body 210 comprises the stepped profile. However, the advantage of attaching the one or more recessed arcuate side portions 230 to the main body 210 is that the main body 210 has a more regular shape and may be manufactured in a more cost-effective manner. The main body 210 may be hollow, i.e. delimit a cavity 201, which may engage with a mounting portion of a mounting surface onto which the luminaire 100 is to be mounted. As this is well-known per se to the skilled person, this will not be explained in further detail for the sake of brevity only.

As shown in FIG. 2 and FIG. 3, the first gear wheel 121 and the second gear wheel(s) 131 may have mutually opposing curvatures, e.g. the arcuate surface section carrying the first gear wheel 121 has a concave curvature and the surface section carrying the second gear wheel 131 of the at least one protruding side section 130 has a convex curvature. As will be understood from the foregoing, as a consequence the end portion 220 of the mounting body 200 carrying the first further gear wheel 221 has a convex curvature and the at least one side portion 230 carrying the second further gear wheel 231 has a concave curvature. Such mutually opposing curvatures have the advantage of improving the grip between the mounting section 110 of the luminaire 100 and the mounting body 200, thereby further improving the robustness of this engagement. Of course it should be understood that the aforementioned curvatures are by way of non-limiting example only and that other mutually opposing curvatures, e.g. the arcuate surface section carrying the first gear wheel 121 has a convex curvature and the surface section carrying the second gear wheel 131 of the at least one protruding side section 130 has a concave curvature equally may be contemplated. It is furthermore noted for the avoidance of doubt that in alternative embodiments the gear wheels 121, 131 of the mounting section 110 all may have the same curvature and the further gear wheels 221, 231 all may have the same complementary or opposing curvature to the gear wheels 121, 131 of the mounted section 110.

In accordance with preferred embodiments of the present invention, the adjustment of the orientation of the luminaire 100 relative to the mounting body 200 is achieved by provision of configurable arrangement between the luminaire 100 and the mounting body 200 in which the engagement between the luminaire 100 and mounting body 200 may be disengaged without physically separating the luminaire 100 from the mounting body 200, such that the orientation of the luminaire 100 relative to the mounting body 200 may be adjusted in the disengaged configuration without the risk of the mounting body 200 becoming physically detached from the luminaire 100 such that an installer of the luminaire 100 can adjust its orientation in a straightforward manner, thereby facilitating the installation of the luminaire 100 onto a mounting surface such as a mounting post as previously explained.

To this end, the luminaire mounting kit 10 is provided with at least one guide pin 20 which couples the mounting section 110 of the luminaire 100 to the mounting body 200 of the luminaire mounting kit 10. In case of a single guide pin 20, such a guide pin typically extends through the full width of the mounting section 110, such that the guide pin 20 may be secured with a securing pin, bolt or the like as will be readily understood by the skilled person. Alternatively, the luminaire mounting kit 10 may be provided with a pair of guide pins 20 that each are secured onto the mounting body 200 in any suitable manner. Each guide pin 20 may be provided with a spacer ring 22 that prevents slippage of the guide pin when extending through at least a part of the mounting section 110.

Figure 5:
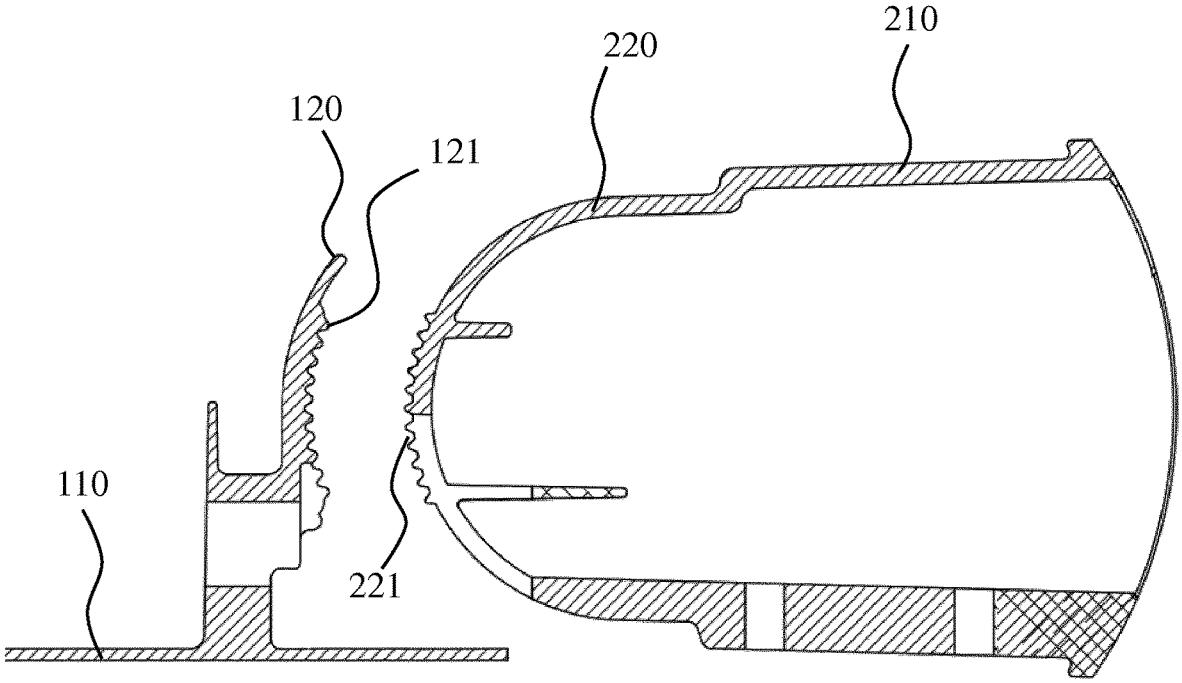
FIG. 5 schematically depicts a side view of a first aspect of a mounting mechanism between a luminaire and a mounting body of a luminaire kit according to an embodiment.
Figure 6:
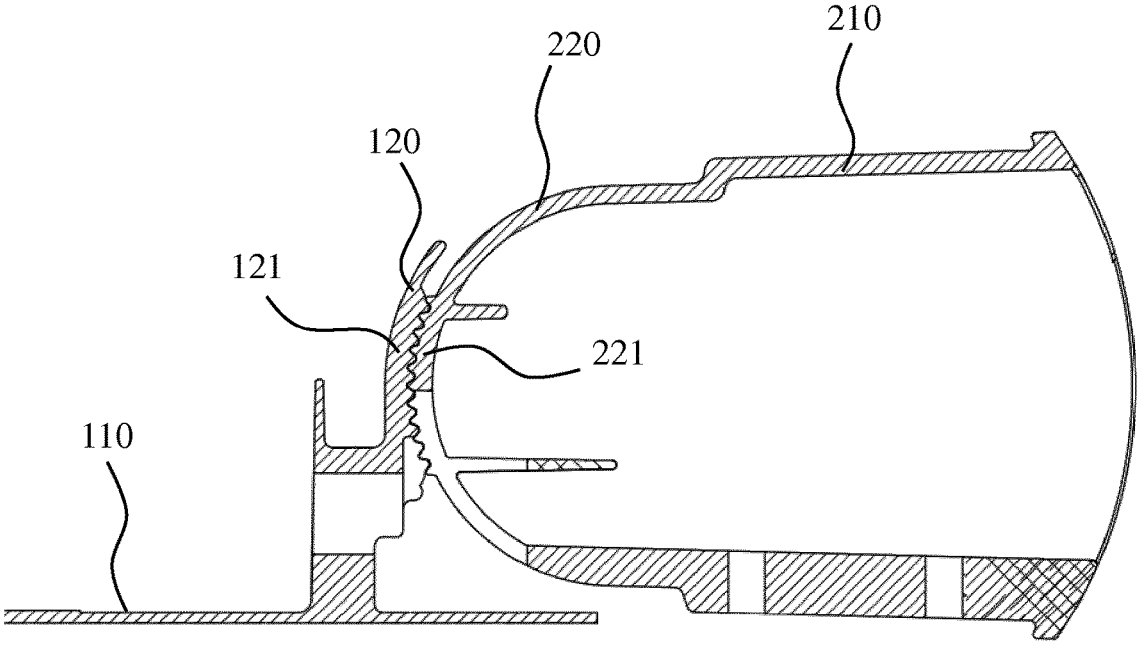
FIG. 6 schematically depicts a side view of a further aspect of a mounting mechanism between a luminaire and a mounting body of a luminaire kit according to an embodiment.
Figure 7:
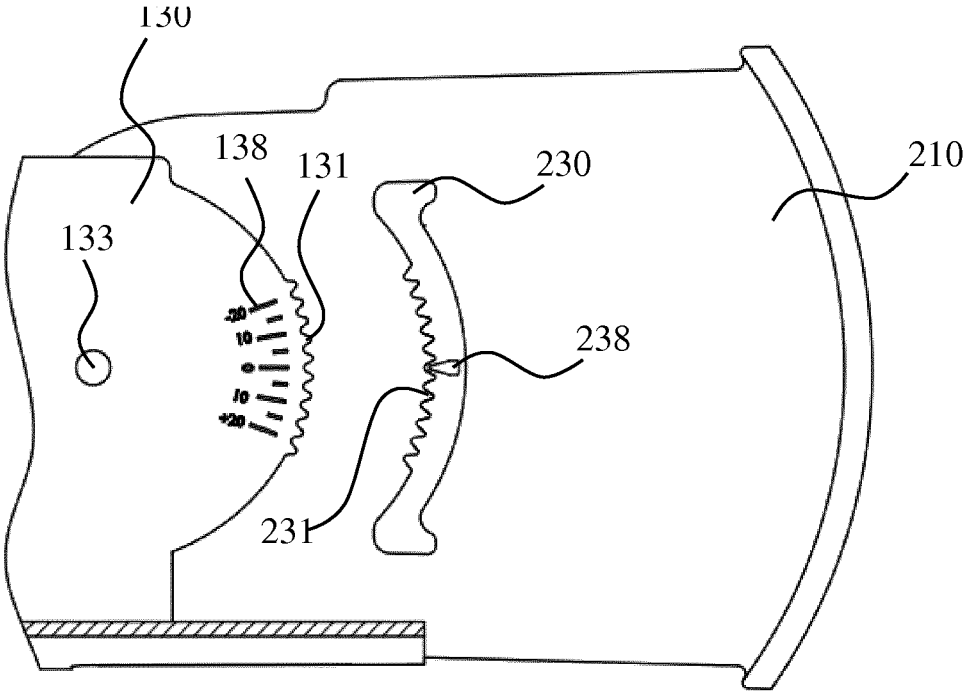
FIG. 7 schematically depicts another side view of the first aspect of the mounting mechanism between a luminaire and a mounting body of a luminaire kit according to an embodiment.
Figure 8:
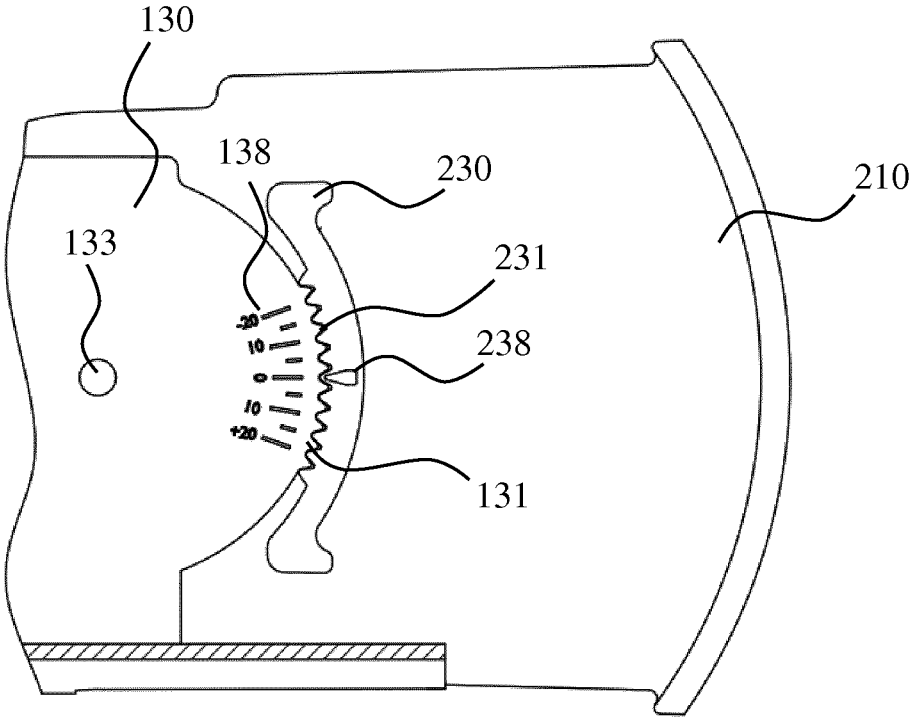
FIG. 8 schematically depicts another side view of the further aspect of the mounting mechanism between a luminaire and a mounting body of a luminaire kit according to an embodiment.
Figure 10:
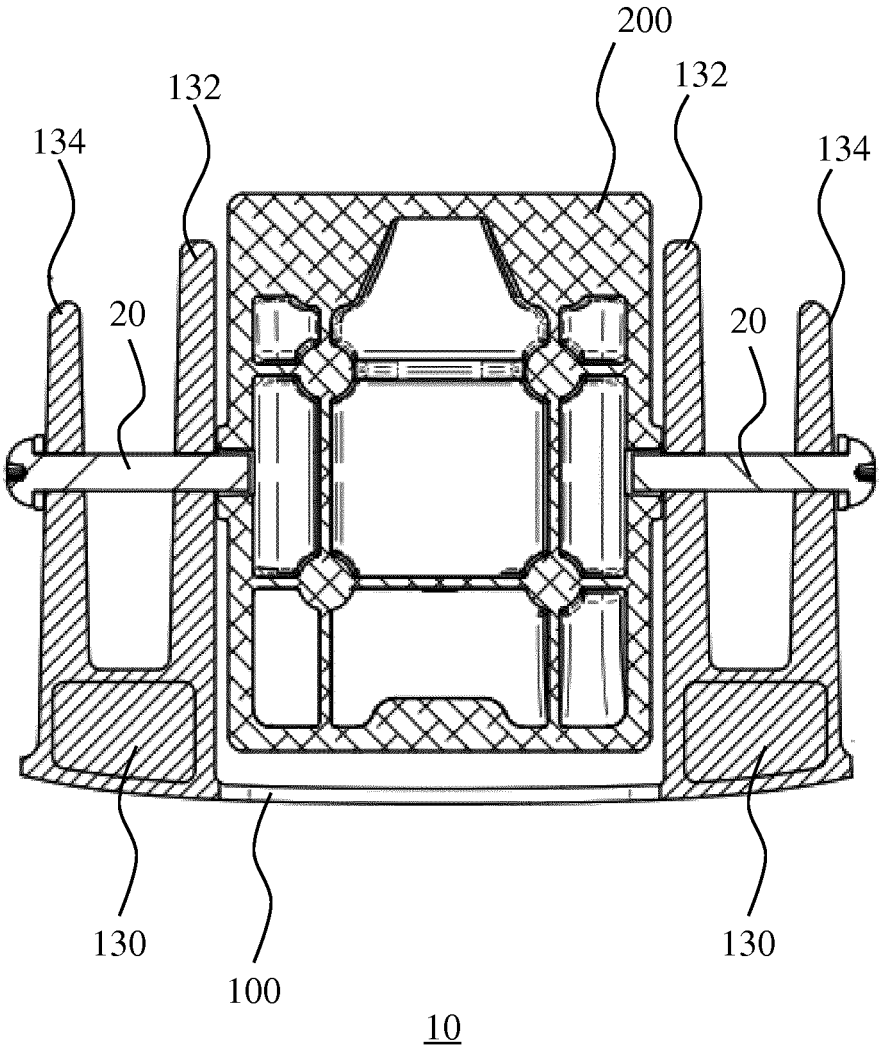
FIG. 10 schematically depicts a cross-sectional view of the luminaire and mounting body of the luminaire kit according to an embodiment in an engaged configuration.

For example, the side surfaces 132, 134 of the at least one protruding section 130 of the mounting section 110 may comprise a through hole or aperture 133 for receiving the guide pin 20, with the side surfaces of the main body 210 of the mounting body 200 comprising a slit or channel 233 for receiving the guide pin 20. Alternatively, the slit or channel 233 may be located on the mounting section 110 and the through hole or aperture 133 may be located on the main body 210 of the mounting body 200. The dimensions of the channel 233 are chosen such that the mounting body 200 may be laterally displaced from a disengaged configuration to an engaged configuration with the luminaire 100 and vice versa. This is schematically depicted in FIG. 5 and FIG. 6, which respectively depict the disengaged and engaged configurations of the first gear wheel 121 and the first further gear wheel 221, and in FIGS. 7 and 8, which respectively depict the disengaged and engaged configurations of a second gear wheel 131 and an opposing second further gear wheel 231. A cross-sectional view of the extension of the guide pins 20 through the mounting section 110 of the luminaire 100 and the mounting body 200 is schematically depicted in FIG. 10.

Figure 9:
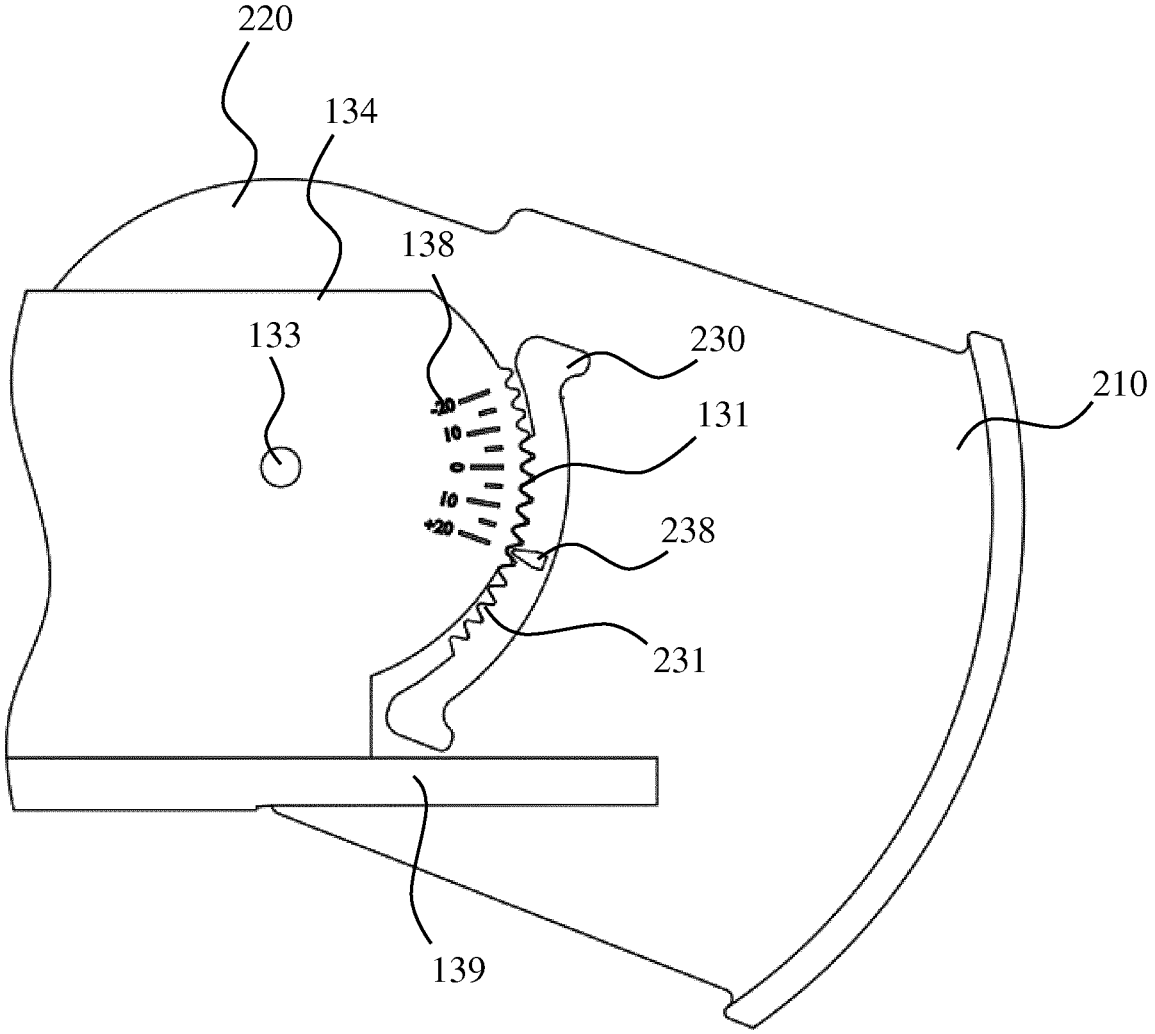
FIG. 9 schematically depicts a side view of an example end position of the mounting mechanism between a luminaire and a mounting body of a luminaire kit according to an embodiment.

In the disengaged configuration, the luminaire 100 may be rotated relative to the mounting body 200 (or vice versa), for example when the mounting body 200 is mounted onto a mounting surface such as a mounting post. This allows for the adjustment of the direction in which the luminaire 100 produces its (directional) luminous output. For example, the orientation of the luminaire 100 may be adjustable such that the luminaire 100 can be positioned under an angle of +20° relative to the mounting body 200 as schematically depicted in FIG. 9 in a first extreme position to an angle of −20° relative to the mounting body 200 in a second extreme position. The extreme positions define the range of angles under which the luminaire 100 may be positioned relative to the mounting body 200. As mentioned previously, this angle may be defined as the angle between a centreline of the luminaire 100 and a centreline of the mounting body 200, which, if the centreline of the mounting body 200 coincides with a horizontal plane, e.g. when the mounting body 200 is mounted horizontally onto a mounting surface, defines the angle as the angle of the centreline of the luminaire 100 with this horizontal plane. In the given example, a positive value of this angle denotes an orientation of the luminaire 100 below this plane and a negative value of this angle denotes an orientation of the luminaire 100 above this plane. However, it should be understood that this is an arbitrary convention and that any suitable alternative convention may be used instead.

In order to assist the installer of the luminaire 100 with installing the luminaire under a correct (e.g. predetermined) mounting angle, the luminaire 100 and the mounting body 200 may comprise visual aids that aid the installer in setting the correct angle under which the luminaire 100 is engaged with the mounting body 200. For example, the outer side surface 134 of the protruding section 130 may display a scale 138 such as a protractor section or the like that defines a range of angles under which the luminaire 100 may be positioned relative to the mounting body 200, and the side surface of the opposing recessed side portion 230 may display an indicator 238 such as an arrow head or the like that allows the alignment of the indicator 238 at the desired angular value on the scale 138 by rotating the luminaire 100 relative to the mounting body 200 (or vice versa) in the disengaged configuration until the alignment of the indicator 238 with the desired angular value on the scale 138 has been achieved. To this end, the indicator 238 preferably is positioned on the centreline of the mounting body 200, and the scale 138 preferably is centered on the centreline of the (mounting section 110) of the luminaire 100. To further facilitate such an alignment, the indicator 238 is preferably located close to the second further gear wheel 233 and the scale 138 preferably is located close to the second gear wheel 133.

In an embodiment, the mounting section 110 may further comprise opposing stop portions 137, 139 that prevent over-rotation of the luminaire 100 relative to the mounting body 200 in the disengaged configuration. Such over-rotation, i.e. positioning of the luminaire 100 relative to the mounting body 200 under an angle exceeding a maximum permissible angle, may lead to only minor portions of the opposing gear wheels 121, 221 and 131, 231 engaging with each other, which could compromise the structural integrity of the coupling between the luminaire 100 and the mounting body 200. The opposing stop portions 137, 139 are typically arranged at opposite ends of each second gear wheel 131 such that at each maximum permissible angle between the luminaire 100 and the mounting body 200 an end portion of the second further gear wheel 231 arranged to engage with the second gear wheel 131 contacts one of the stop portions 137, 139 in the disengaged configuration between the luminaire 100 and mounting body 200 to prevent such over-rotation.

After the desired positioning of the luminaire 100 relative to the mounting body 200, the mounting body 200 and/or luminaire 100 may be laterally displaced along the guide pin(s) 20 to engage the respective gear wheels 121, 131 of the luminaire 100 with the respective further gear wheels 221, 231 of the mounting body 200 to 'lock' the luminaire 100 in its desired orientation. In order to lock the mounting body 200 onto the luminaire 100 such that the engagement of the luminaire 100 in the desired orientation with the mounting body 200 cannot be accidentally undone, the luminaire mounting kit 10 may further comprise a pair of fastening screws 30 (or more) for fastening the mounting body 200 to the mounting portion 110 of the luminaire 100. Such fastening screws 30 typically extend through a portion of the mounting body 200 and are secured onto the mounting section 110 of the luminaire 100. For example, each of the side portions 230 of the mounting body 200 may delimit a slot or channel 235 for receiving such a fastening screw 30, whereas each opposing protruding section 130 may comprise a threaded hole 135 for securing the fastening screw 30, thereby fixating the engagement between the respective gear wheels 121, 131 of the luminaire 100 with the respective further gear wheels 221, 231. Each fastening screw 30 may be provided with one or more space rings 32, 34, e.g. to prevent slippage of the fastening screw 30 as is well-known per se to the skilled person. It is noted for the avoidance of doubt that the term 'fastening screw' should not construed narrowly, as this term is intended to cover any fixing member that may be used to affix the mounting body 200 to the luminaire 100 in an engaged configuration.

Hence, in summary, the luminaire mounting kit 10 according to embodiments of the present invention allows a straightforward installation method of the luminaire 100 onto a mounting surface, such as a mounting post by way of non-limiting example. In this installation method, an installer may simply attach the mounting body 200 to this mounting surface in any suitable manner, for example using screws 40 and nuts 42 by way of non-limiting example, slot the mounting body 200 into the mounting portion 110; position the luminaire 100 in a desired orientation relative to the mounting body 200 and affix the luminaire 100 to the mounting body, e.g. using fastening screws 30. As explained above, the positioning of the luminaire 100 in a desired orientation relative to the mounting body (200) may comprise (maintaining) the disengagement of the first and second gear wheel portions 121, 131 of the mounting section 110 from the respective first further and second further gear wheel portions 221, 231 of the mounting body 200; adjusting the orientation angle of the luminaire 100 relative to the mounting body 200 to obtain the desired orientation; and engaging the first and second gear wheel portions 121, 131 of the mounting section 110 with the respective first further and second further gear wheel portions 221, 231 of the mounting body 200.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A luminaire mounting kit comprising:

a luminaire having a mounting section comprising a recessed section carrying a first gear wheel portion, the recessed section being flanked by at least one protruding section carrying a second gear wheel portion; and a mounting body for engaging with the mounting section, the mounting body comprising:

a protruding end portion carrying a first further gear wheel portion for engaging with the first gear wheel portion; and at least one recessed side portion flanking said end portion and carrying a second further gear wheel portion arranged to simultaneously engage with the second gear wheel portion when the first further gear wheel portion engages with the first gear wheel portion;

wherein the first gear wheel portion is concavely shaped and the first further gear wheel portion is convexly shaped; and wherein each second gear wheel portion is convexly shaped and each second further gear wheel portion is concavely shaped.

2. The luminaire mounting kit of claim 1, wherein:

the mounting section comprises a pair of protruding sections flanking opposite sides of the recessed section and each comprising a second gear wheel portion; and the mounting body comprises a pair of the recessed side portions flanking opposite sides of the protruding end portion and each comprising a second further gear wheel portion arranged to simultaneously engage with a respective second gear wheel portion when the first further gear wheel portion engages with the first gear wheel portion.

3. The luminaire mounting kit of claim 1, wherein the recessed side portions extend from a main body of the mounting body.

4. The luminaire mounting kit of claim 1, further comprising at least one guide pin, wherein:

each protruding section comprises one of a mounting hole and a channel for receiving said at least one guide pin; and each side of the mounting body comprises another one of the mounting hole and the channel, wherein said channel allows the displacement of the mounting body relative to the mounting portion of the luminaire between a first configuration in which the first and second gear wheel portions of the mounting section are engaged with the respective first further and second further gear wheel portions of the mounting body and a second configuration in which the first and second gear wheel portions of the mounting section are disengaged from the respective first further and second further gear wheel portions of the mounting body.

5. The luminaire mounting kit of claim 4, further comprising a pair of said guide pins, wherein:

each protruding section comprises the mounting hole for receiving said one of said guide pins; and each side of the mounting body comprises the channel.

6. The luminaire mounting kit of claim 1, wherein the first further and second further gear wheel portions of the mounting body and the first and second gear wheel portions of the mounting portion are dimensioned such that a fixation angle between the luminaire and the mounting body can be adjusted within a range of −20° to 20°.

7. The luminaire mounting kit of claim 1, wherein each second gear wheel portion is located in between a pair of stop portions, said stop portions limiting a displacement range of each second further gear wheel portion relative to said second gear wheel portion.

8. The luminaire mounting kit of claim 1, further comprising a pair of fastening screws for fastening the mounting body to the mounting portion of the luminaire.

9. The luminaire mounting kit of claim 8, wherein:

each of the side portions delimits a slot for receiving one of said fastening screws; and each of the protruding sections comprises a threaded hole for securing one of said fastening screws.

10. The luminaire mounting kit of claim 1, wherein the luminaire is a street amp.

11. The luminaire mounting kit of claim 1, wherein the mounting body is a spigot for mounting the luminaire onto a mounting post.

12. A luminaire assembly comprising the luminaire mounting kit of claim 11 and the mounting post.

13. A method of mounting the luminaire mounting kit of claim 1 onto a mounting surface, the method comprising:

attaching the mounting body to said mounting surface;

slotting the mounting body into the mounting portion;

positioning the luminaire in a desired orientation relative to the mounting body; and affixing the luminaire to the mounting body.

14. The method of claim 13, wherein positioning the luminaire in a desired orientation relative to the mounting body comprises:

disengaging the first and second gear wheel portions of the mounting section from the respective first further and second further gear wheel portions of the mounting body;

adjusting the orientation angle of the luminaire relative to the mounting body to obtain said desired orientation; and engaging the first and second gear wheel portions of the mounting section with the respective first further and second further gear wheel portions of the mounting body.

* * * * *